US007261654B2

(12) United States Patent
Cheng

(10) Patent No.: US 7,261,654 B2
(45) Date of Patent: Aug. 28, 2007

(54) EXTENDABLE BAT

(76) Inventor: Chen-Hua Cheng, 6F-6, No. 333, Sec. 2, Huamei W. St., Taichung City (TW)

( * ) Notice: Subject to any disclaimer, the term of this patent is extended or adjusted under 35 U.S.C. 154(b) by 0 days.

(21) Appl. No.: 11/305,435

(22) Filed: Dec. 16, 2005

(65) Prior Publication Data

US 2007/0142135 A1 Jun. 21, 2007

(51) Int. Cl.
*A63B 69/00* (2006.01)

(52) U.S. Cl. ..... 473/457; 473/564

(58) Field of Classification Search ..... 473/422, 473/457, 564–568

See application file for complete search history.

(56) References Cited

U.S. PATENT DOCUMENTS 3,955,816 A * 5/1976 Bratt ..... 473/457
5,133,551 A * 7/1992 Handy et al. ..... 473/567
5,219,164 A * 6/1993 Peng ..... 473/520
6,319,157 B1 * 11/2001 Broadbent ..... 473/446
6,511,392 B1 * 1/2003 Chohan ..... 473/564
6,540,627 B1 * 4/2003 Leal et al. ..... 473/564
6,669,584 B1 * 12/2003 Miller ..... 473/568
2002/0072436 A1 * 6/2002 Liu ..... 473/457

* cited by examiner

*Primary Examiner*—Mitra Aryanpour
(74) *Attorney, Agent, or Firm*—patenttm.us; James H. Walters

(57) ABSTRACT

An extendable bat has a covering member, a tubular core, a handle, an adjusting device, a cap, and a collar. The adjusting device has a first locking member and a second locking member. With the cooperation of the first locking member and the second locking member, the length of the bat can be adjusted and the handle is held in place at a desired length. Accordingly, the cost for manufacturing the extendable bat is lowered.

5 Claims, 10 Drawing Sheets

EXTENDABLE BAT

BACKGROUND OF THE INVENTION

1. Field of the Invention

The present invention relates to a bat, and particularly relates to an extendable bat.

2. Description of the Related Art

With reference to FIGS. 8-10, a conventional bat has a covering member (50), a tubular core (60), a handle (70), an adjusting device (80), and a cap (65).

The covering member (50) made of foam plastic materials is mounted around the tubular core (60) and has a front end (51) and a rear end (52). The front end (51) is equipped with the cap (65). The tubular core (60) is hollow and has a front end (61) and a rear end (62). An annular slot (63) is defined in an outer periphery of the tubular core near the rear end (62), and a rail (64) is axially formed an inner wall of the tubular core (60). The handle (70) has a front end (71) and a rear end (72). The handle (70) is adjustably mounted in the tubular core (60) to adjust the length of the bat. The adjusting device (80) is composed of a first locking member (81) formed in the front end (71) and a second locking member (85) slidably mounted in the tubular core (60). The first locking member (81) has a stop ridge (82), and a taper head (83) with outer screw thread extending from the stop ridge (82). The second locking member (85) has a split sleeve (86), an inner thread (87) defined in the split sleeve (86), a channel (88) defined axially in an outer periphery of the split sleeve (86) to engage with the rail (64), and a slit (89) is defined in the split sleeve (86) axially.

To adjust the length of the conventional bat, the handle (70) is rotated and the first locking member (81) is rotated with the handle. Then, the taper head (83) is retracted from the second locking member (85), such that the handle (70) can be moved outward or inward the tubular core (60) so as to adjust the length of the bat. When the stop ridge (82) engages with the annular slot (63), the handle will not be moved anymore to achieve the longest length of the bat. In addition, with the arrangement of the slit (89), a resilient force is provided to the split sleeve (86). Accordingly, the taper head (83) of the first locking member (81) is securely engaged with the split sleeve (86) of the second locking member (85) to hold the handle (70) in place relative to the tubular core (60).

However, to form the inner thread (87) inside the split sleeve (86) is difficult, and the split sleeve (86) with the taper head (83) easily disengages from each other. In addition, when the handle (70) is completely held inside the tubular core (60), the cap (65) will be pushed by the handle (70) to be escaped from the covering member (50).

Therefore, the invention provides an extendable bat to mitigate or obviate the aforementioned problems.

SUMMARY OF THE INVENTION

The main objective of the present invention is to provide an extendable bat that is easily manufactured and has a durable structure. The extendable bat has a covering member made of foam plastic material, having a front end and a rear end;

a tubular core mounted inside the covering member and having a front end, a rear end, an inner wall with a toothed cross section and an annular slot defined in the tubular core near the rear end of the tubular core;

a handle adjustably mounted in the tubular core and having a front end inserted into the rear end of the tubular core and a rear end extending out from the rear end of the tubular core;

an adjusting device mounted between the handle and the tubular core and having a first locking member and a second locking member, wherein the first locking member has an annular stop formed on and radially extending from the first locking member;

a taper head attached to and axially extending from the annular stop; and a stud axially extending from a middle of the taper head and having a thread near the taper head; and the second locking member has a drive loop mounted around the stud and screwed onto the thread on the stud, two semicircular clamps mounted around the drive loop and abutting with the tubular core, and each clamp comprising a curved slot defined in a middle of the clamp, a cone-shaped cavity defined in a rear end of the semicircular clamp and corresponding to the taper head; and a toothed outer surface corresponding to and engaging with the toothed inner wall of the tubular core, and a resilient ring mounted around the clamps and held inside the curved slots in the clamps to combine the clamps together.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
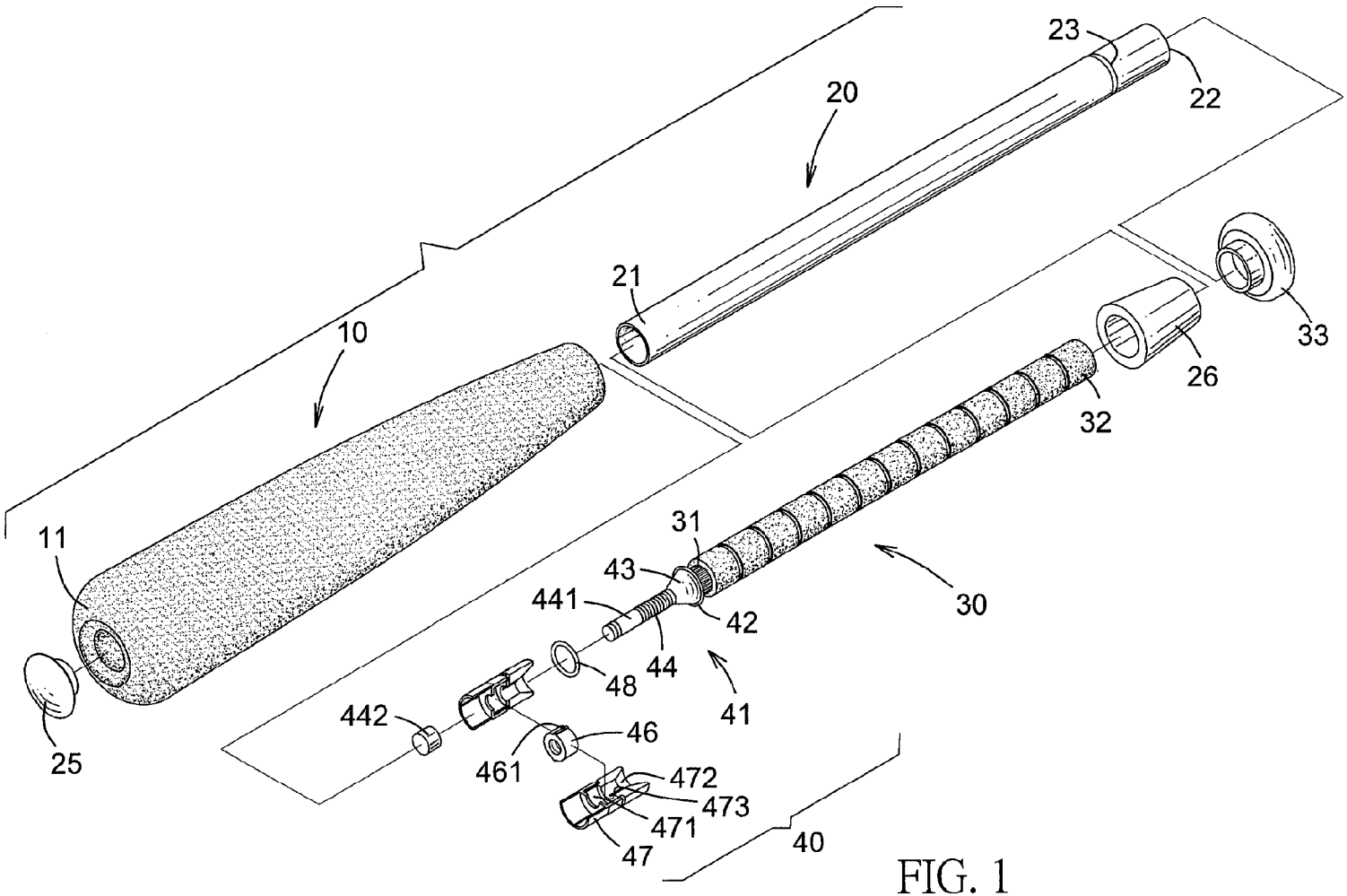
FIG. 1 is an exploded view of an extendable bat in accordance with this invention.
Figure 2:
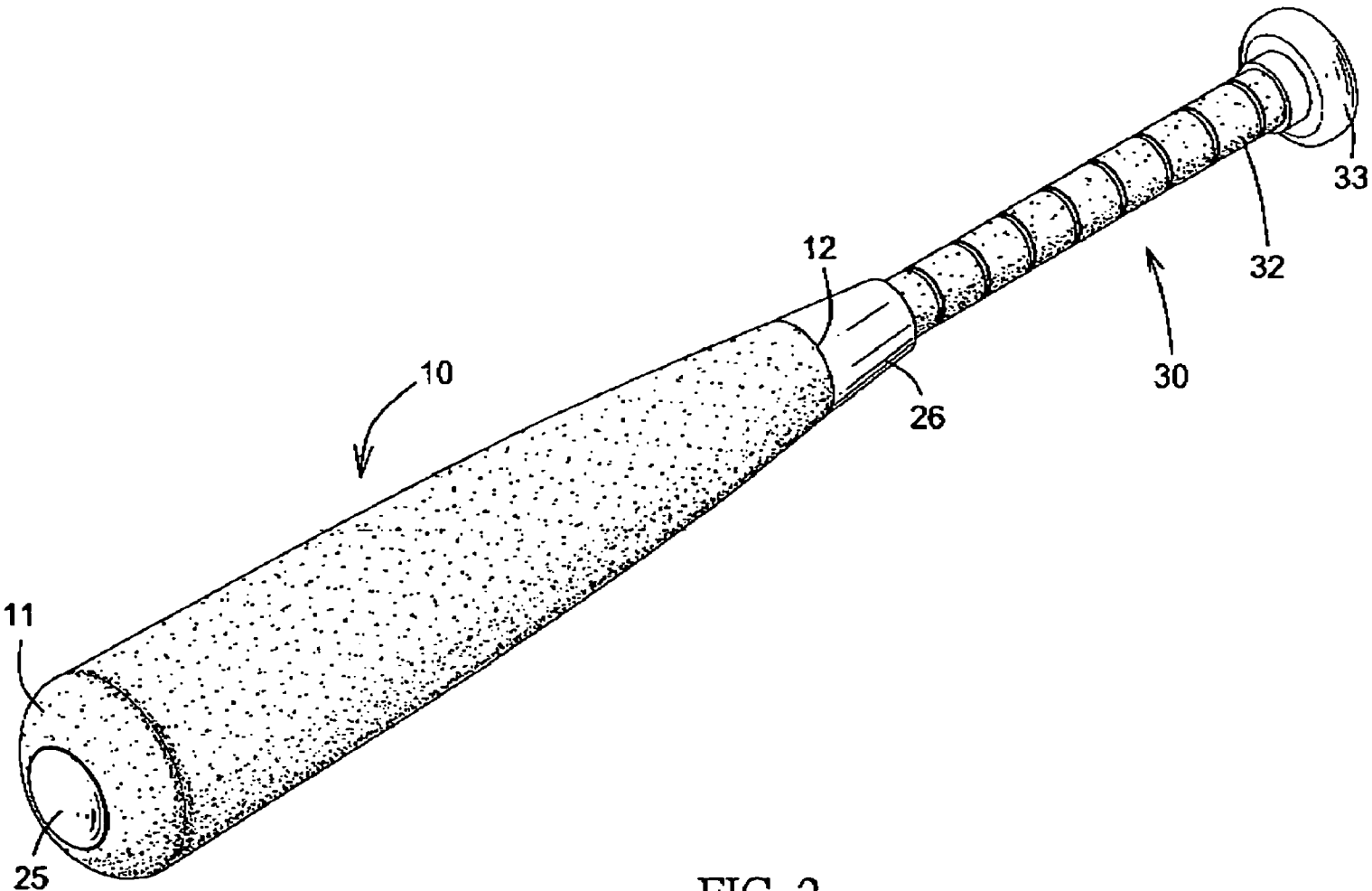
FIG. 2 is a perspective view of the extendable bat in FIG. 1.
Figure 3:
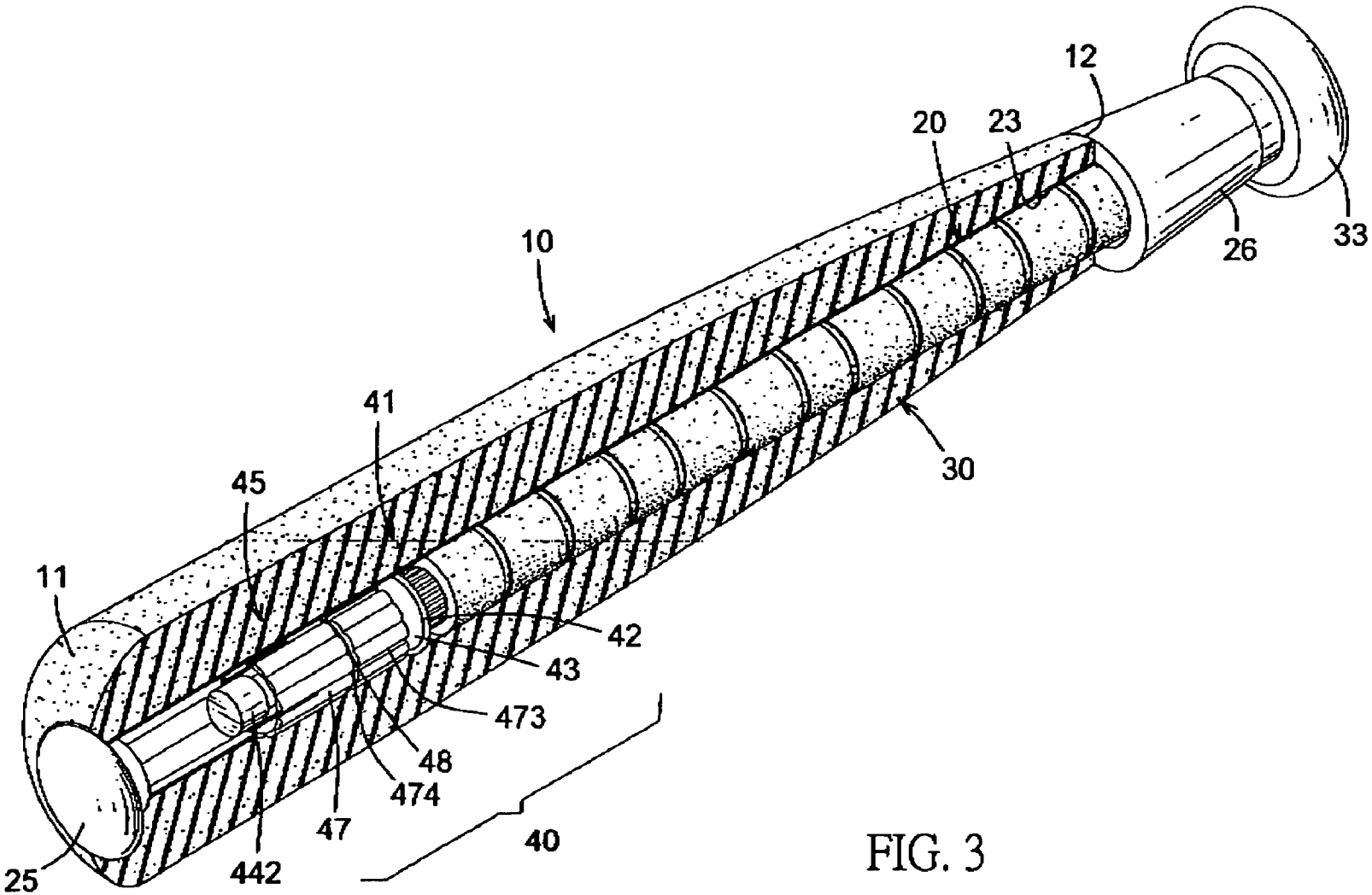
FIG. 3 is a perspective view in partial cross section of the extendable bat in FIG. 2.
Figure 4:
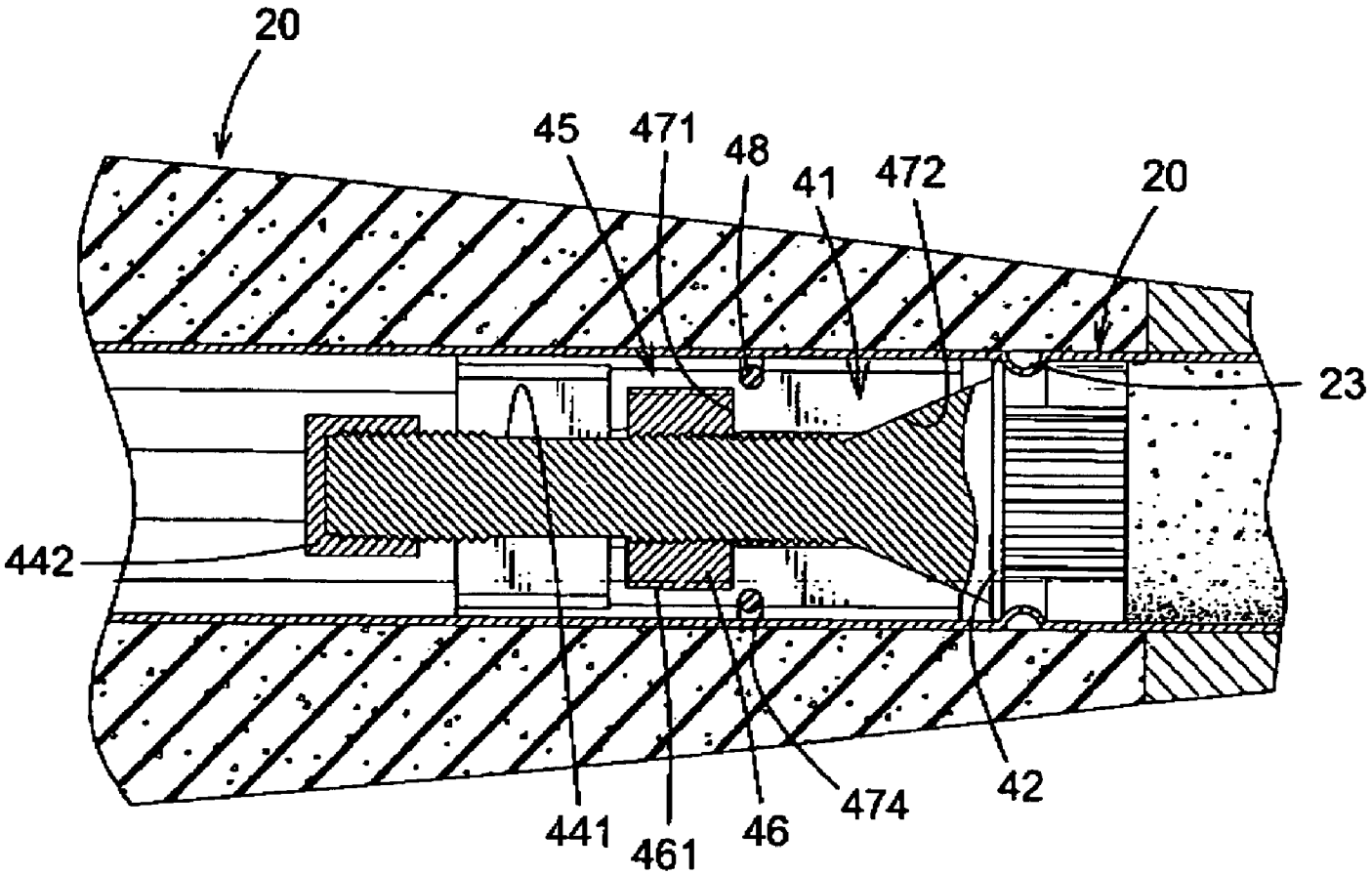
FIG. 4 is a side plan view in partial cross section of an adjusting device of the extendable bat in FIG. 1.

With reference to FIGS. 1-4, an extendable bat in accordance with the present invention has a covering member (10), a tubular core (20), a handle (30), an adjusting device (40), a cap (25) and a collar (26).

The covering member (10) made of foam plastic materials is mounted around the tubular core (20) and has a front end (11) and a rear end (12).

The tubular core (20) has a front end (21) and a rear end (22). An annular slot (23) is defined in the outer periphery of the core (20) near the rear end (22), and the rear end (22) is equipped with the collar (26). In addition, the tubular core (20) has an inner wall with a toothed cross section.

The handle (30) has a front end (31) and a rear end (32). The front end (31) is inserted into the rear end (22) of the tubular core (20), and the rear end (32) extends out from the rear end (22) of the tubular core (20). The handle (30) is slidably mounted in the tubular core (60) for adjusting the length of the bat. The rear end (32) of the handle (30) is equipped with a lid (33).

The adjusting device (40) is mounted between the tubular core (20) and the handle (30) and has a first locking member (41) formed at the front end (31) of the handle (30) and a second locking member (45). The length of the handle (30) with the first locking member (41) is shorter than that of the tubular core (20). The first locking member (41) has an annular stop (42), a taper head (43) and a stud (44). The annular stop (42) is formed on and radially extends from the locking member (41) and selectively corresponds to and engages the annular slot (23) in the tubular core (20) when the bat is extended to the longest lengthy. The taper head (43) is attached to and axially extends from the annular stop (42), and the stud (44) axially extends from a middle of the taper head (43). The stud (44) has a thread formed near the taper head and a non-threaded portion (441) formed at the free end of the stud (44), and a block (442) is attached to the free end of the stud (44). The second locking member (45) has a drive loop (46) with two rectangular buttons (461) formed on the drive loop (46) and opposite to each other. The drive loop (46) is mounted around the stud (44), and the drive loop (46) is held inside between two semicircular clamps (47). A resilient ring (48) is mounted around the clamps (47) to combine the clamps (47) together. Each semicircular clamp (47) has a notch (471) defined therein and corresponding to the drive loop (46), and a cone-shaped cavity (472) is defined in a rear end of the semicircular clamps (47) and corresponds to the taper head (43). A slit (473) is defined in each clamp (47) from a middle of the clamp (47) to the rear end of the clamp (47), whereby the rear end of each clamp (47) is divided into two pieces. A curved slot (474) is defined in the middle of each clamp (47), such that the resilient ring (48) is held inside the curved slots (474) in the clamps (47). Each clamp has a toothed outer surface corresponding to and engaging with the toothed inner wall of the tubular core (20), so that the second locking member (45) is securely held inside the tubular core (20) and is not rotated relative to the tubular core (20)

Figure 5:
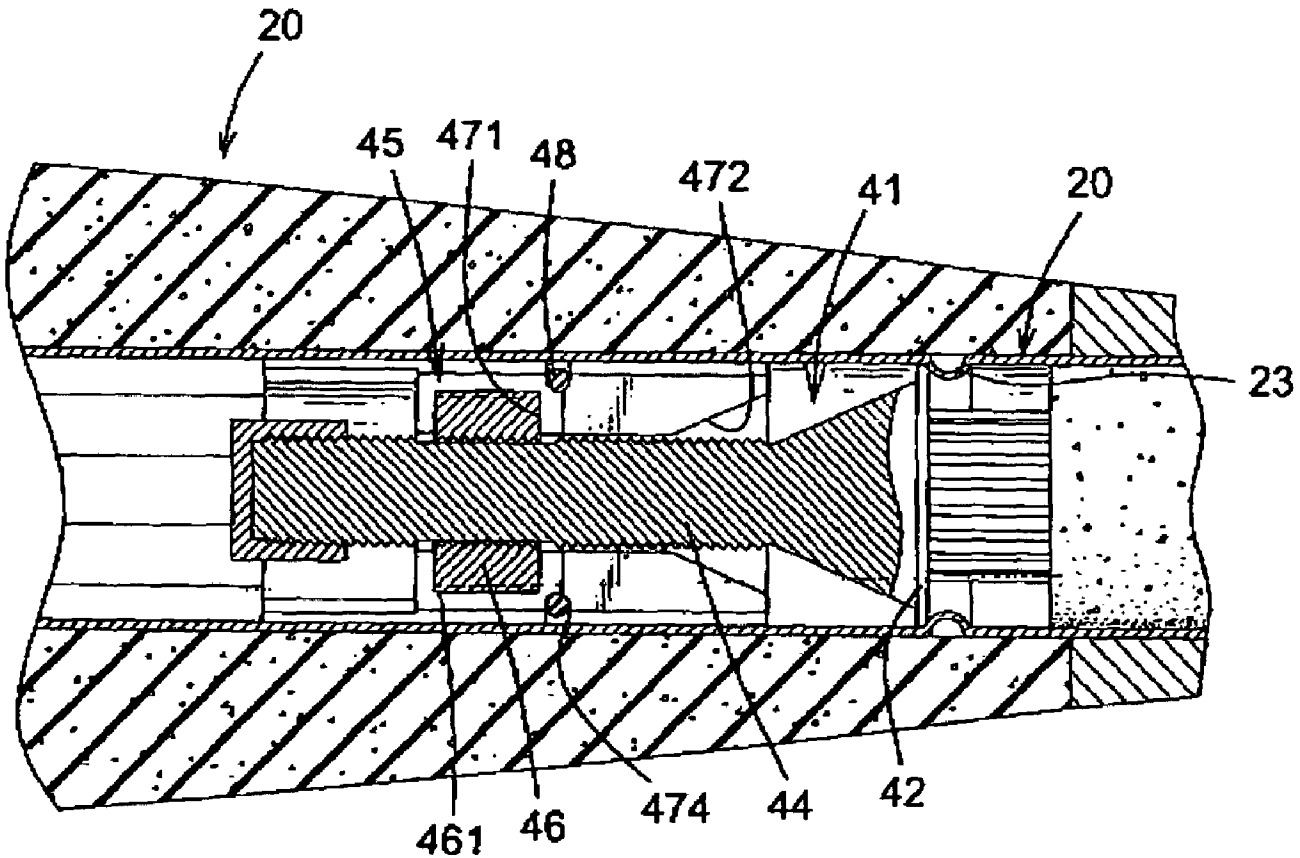
FIG. 5 is an operational side plan view in partial cross section of the adjusting device in FIG. 4 showing that the drive loop is moved to a non-threaded portion.
Figure 6:
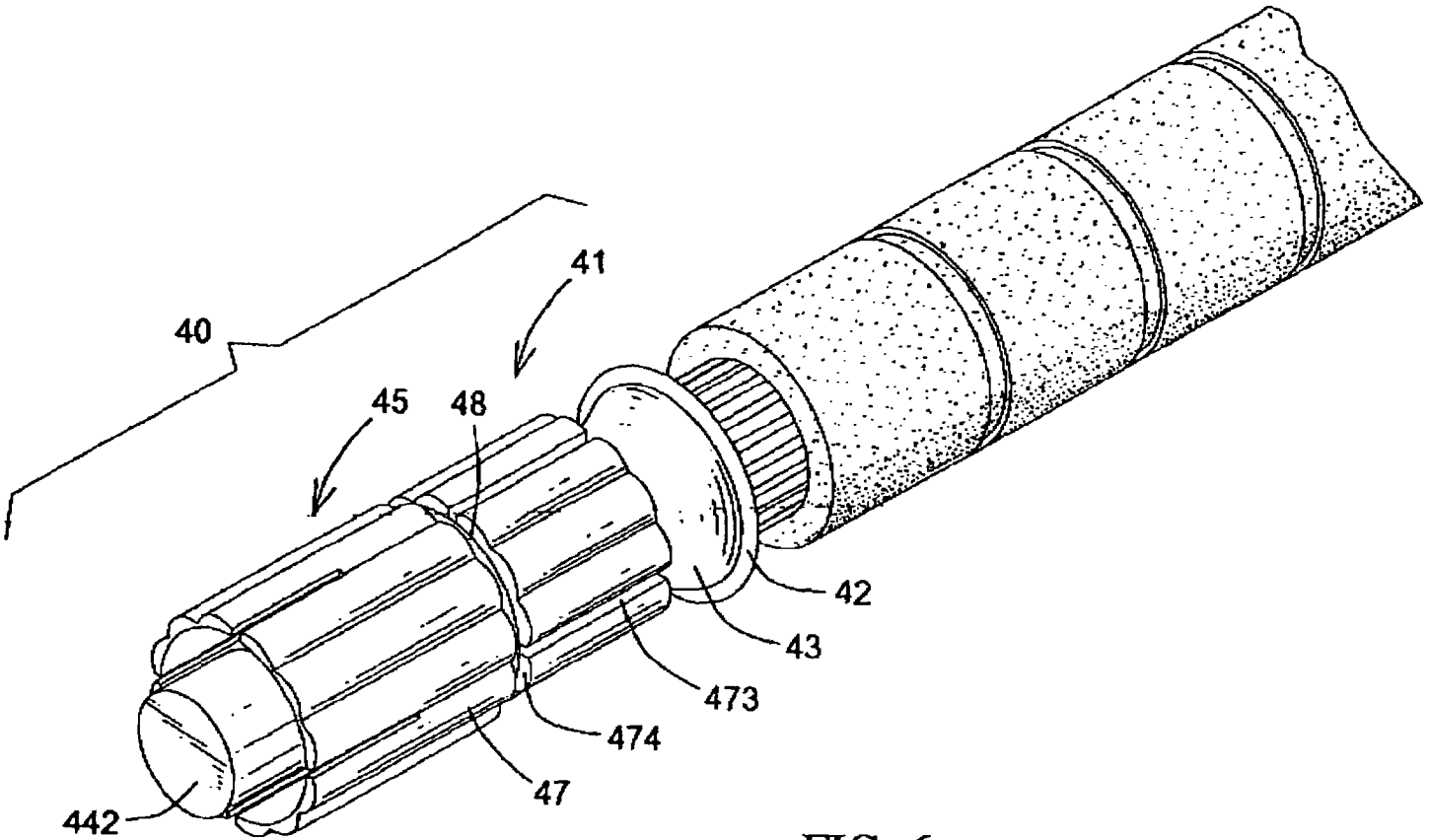
FIG. 6 is an enlarged perspective view of the adjusting device in FIG. 1.
Figure 7:
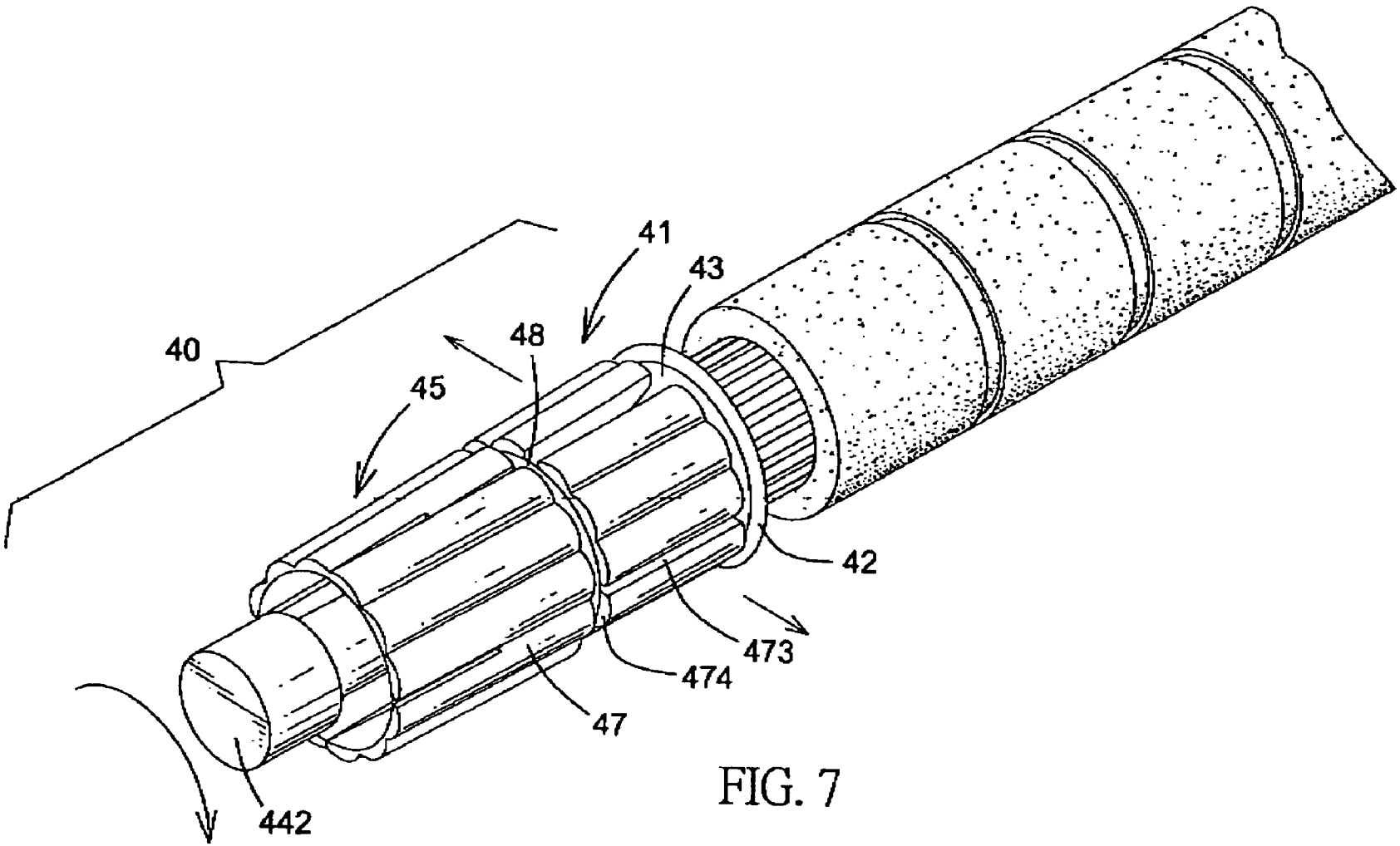
FIG. 7 is an operational perspective view of the adjusting device in FIG. 6 showing that the clamps expand outwardly.
Figure 8:
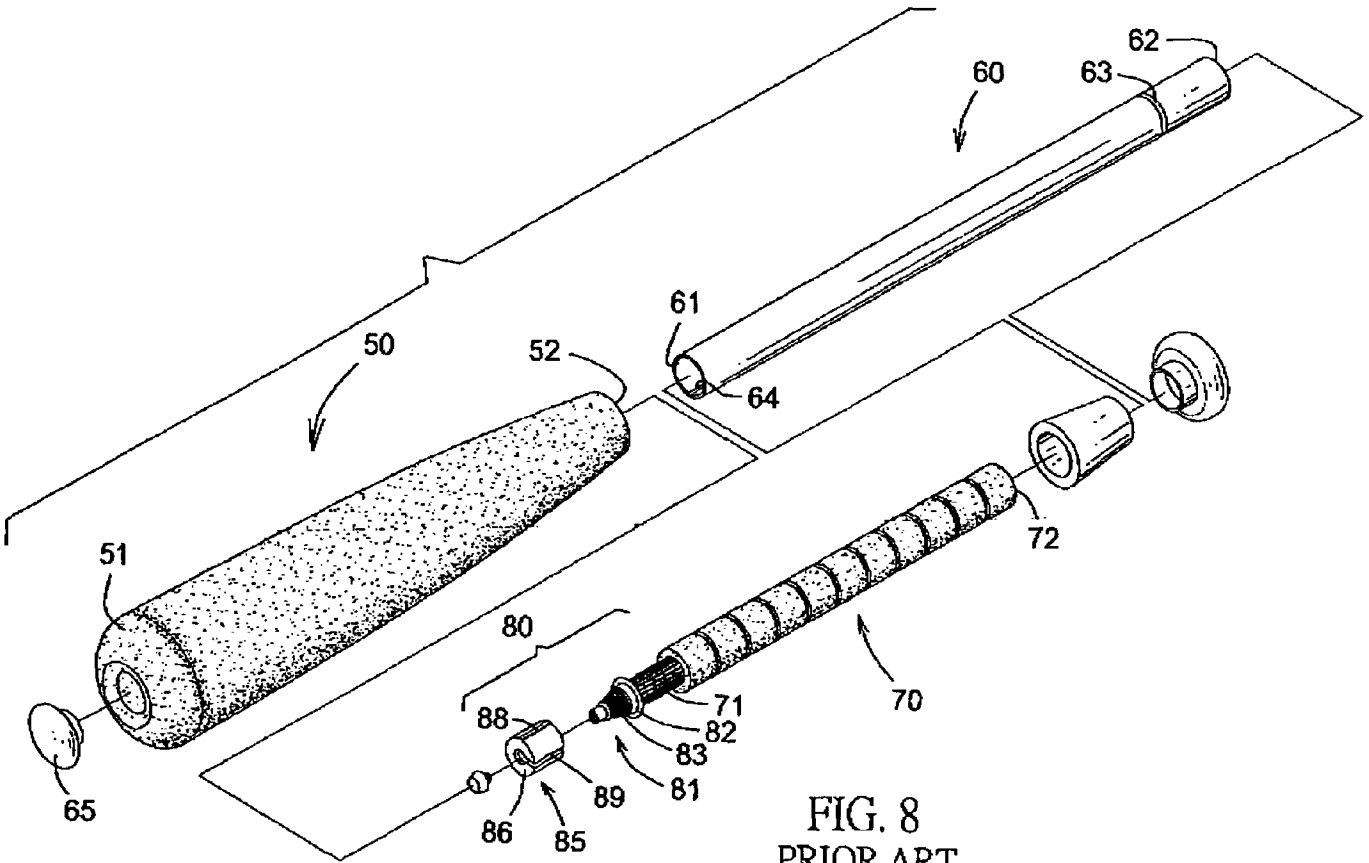
FIG. 8 PRIOR ART
FIG. 8 is an exploded perspective view of a conventional bat in accordance with the prior art.
Figure 9:
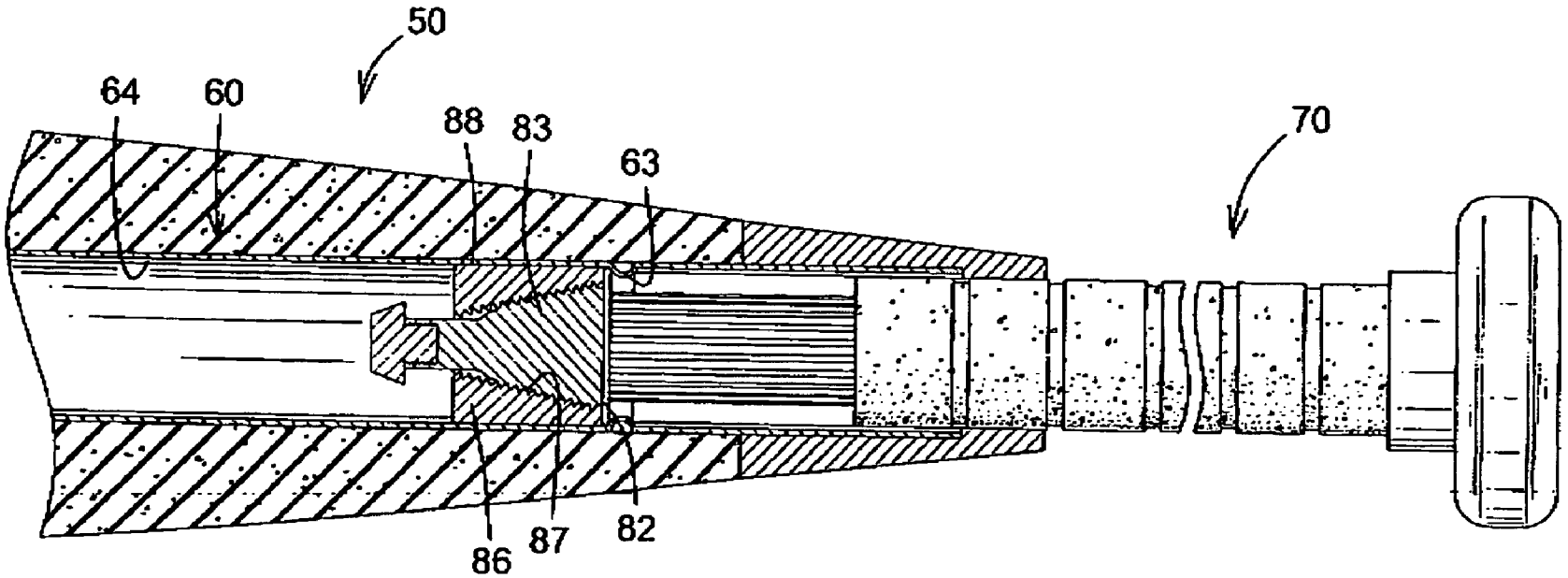
FIG. 9 PRIOR ART
FIG. 9 is a side plan view in partial cross section of the conventional bat in FIG. 8.
Figure 10:
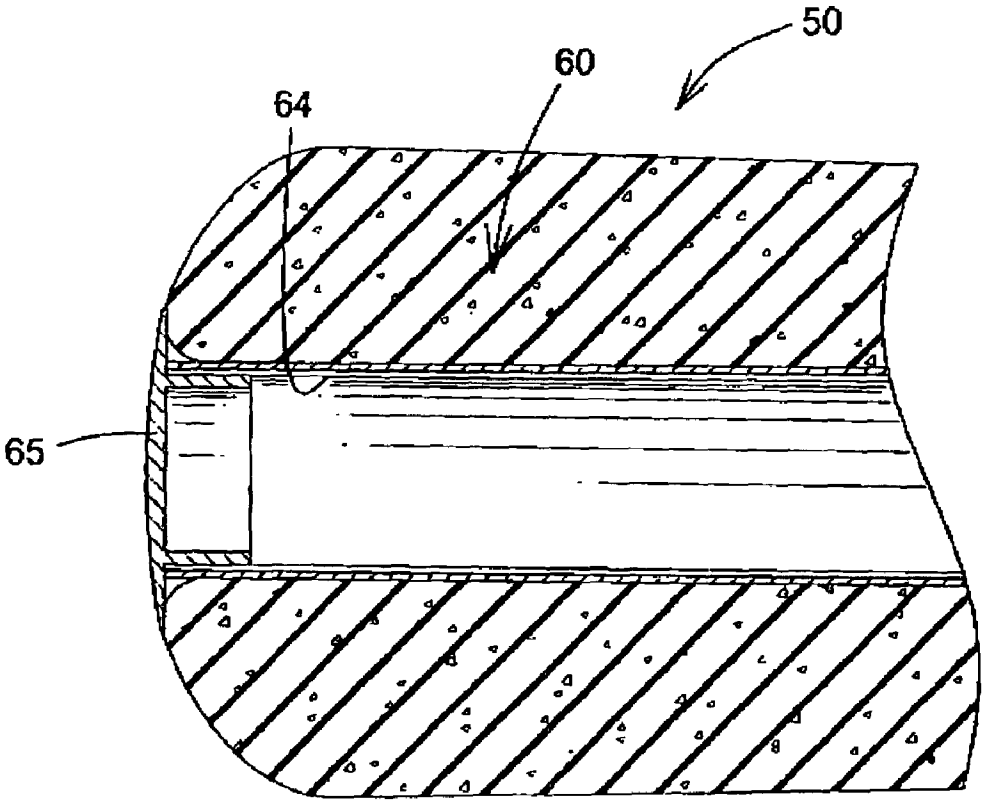
FIG. 10 PRIOR ART
FIG. 10 is an enlarged cross sectional side plan view of the conventional bat in FIG. 8.

With reference to FIGS. 4-7, when the drive loop (46) is screwed onto the thread on the stud (44), the taper head (43) is held inside the coneshaped cavities (472) in the clamps (47). The clamps (47) are expanded to securely contact with the inner wall of the tubular core (20). With the friction between the clamps (47) and the tubular core (20), the handle (30) is held in place.

To adjust the length of the bar, the handle (30) is rotated, the drive loop (46) held by the clamps (47) will move forward and backward relative to the stud (44) to make the cone-shaped cavities (472) leave from the taper head (43) When the drive loop (46) is moved to the non-threaded portion (441), the friction between the two clamps (47) and the tubular core (20) will be released. Accordingly, the handle (30) can be pulled from or pushed into the tubular core (20) to adjust the length of the bat. When the bat is adjusted to a desired length, the handle (30) is rotated reversely and the drive loop (46) is moved to screw onto the thread on the stud (44) again. Consequently, the clamps (47) are expended to hold the handle (30) in position at a desired length.

In such an arrangement, because to form inner thread in the clamps (47) is unnecessary, to manufacture an extendable bat in accordance with the present invention is convenient and at a lower cost. In addition, with the expansion of the clamps (47), the handle (30) can be securely held in position relative to the tubular core (20), and the clamps (47) are not disengaged from the taper head (43)

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An extendable bat comprising a covering member made of foam plastic material, having a front end and a rear end;

a tubular core mounted inside the covering member and having a front end, a rear end, an inner wall with a toothed cross section and an annular slot defined in the tubular core near the rear end of the tubular core;

a handle adjustably mounted in the tubular core and having a front end inserted into the rear end of the tubular core and a rear end extending out from the rear end of the tubular core;

an adjusting device mounted between the handle and the tubular core and having a first locking member and a second locking member, wherein the first locking member has an annular stop formed on and radially extending from the first locking member;

a taper head attached to and axially extending from the annular stop; and a stud axially extending from a middle of the taper head and having a thread near the taper head; and the second locking member has a drive loop mounted around the stud and screwed onto the thread on the stud, two semicircular clamps mounted around the drive loop and abutting the tubular core, and each clamp comprising a curved slot defined in a middle of the clamp, a cone-shaped cavity defined in a rear end of the semicircular clamp and corresponding to the taper head; and a toothed outer surface corresponding to and engaging the toothed inner wall of the tubular core, and a resilient ring mounted around the clamps and held inside the curved slots in the clamps to combine the clamps together.

2. The extendable bat as claimed in claim 1, wherein each clamp has a slit defined from a middle of the clamp to the rear end of the clamp.

3. The extendable bat as claimed in claim 1, wherein a non-thread portion is formed at a free end of the stud and the free end of the stud is equipped with a block.

4. The extendable bat as claimed in claim 1, wherein a length of the handle with the first locking member is shorter than that of the tubular core.

5. The extendable bat as claimed in claim 3, wherein a length of the handle with the first locking member is shorter than that of the tubular core.

* * * * *